US006966187B2

(12) United States Patent
Modi et al.

(10) Patent No.: US 6,966,187 B2
(45) Date of Patent: Nov. 22, 2005

(54) FLAME TUBE OR "LINER" FOR A COMBUSTION CHAMBER OF A GAS TURBINE WITH LOW EMISSION OF POLLUTANTS

(75) Inventors: Roberto Modi, San Piero a Sieve (IT); Luciano Bonciani, Florence (IT); Gianni Ceccherini, Sesto Fiorentino (IT)

(73) Assignee: Nuovo Pignone Holding S.p.A., Florence (IT)

( * ) Notice: Subject to any disclaimer, the term of this patent is extended or adjusted under 35 U.S.C. 154(b) by 207 days.

(21) Appl. No.: 10/320,726

(22) Filed: Dec. 17, 2002

(65) Prior Publication Data

US 2003/0118963 A1 Jun. 26, 2003

(30) Foreign Application Priority Data

Dec. 21, 2001 (IT) ..... MI2001A2785

(51) Int. Cl.[7] ..... F02C 2/00; F02G 3/00
(52) U.S. Cl. ..... 60/752; 60/737; 60/754
(58) Field of Search ..... 60/737, 738, 752, 60/754, 755, 756, 757, 758, 760, 805, 806

(56) References Cited

U.S. PATENT DOCUMENTS

| | | | | |
|---|---|---|---|---|
| 4,201,047 | A * | 5/1980 | Warren et al. | 60/39.63 |
| 4,211,073 | A * | 7/1980 | Guillot | 60/746 |
| 6,134,877 | A * | 10/2000 | Alkabie | 60/800 |
| 6,408,628 | B1 * | 6/2002 | Pidcock et al. | 60/752 |
| 6,427,446 | B1 * | 8/2002 | Kraft et al. | 60/737 |
| 6,446,438 | B1 * | 9/2002 | Kraft et al. | 60/737 |
| 2003/0014975 | A1 * | 1/2003 | Nishida et al. | 60/737 |

* cited by examiner

*Primary Examiner*—William H. Rodriguez
(74) *Attorney, Agent, or Firm*—Nixon & Vanderhye, P.C.

(57) ABSTRACT

An improved flame tube or "liner" (112) for a combustion chamber (110) of a gas turbine with low emission of pollutants, of the type comprising a cylindrical structure connected to the outlet of a premixing chamber (114) by means of a truncated conical end (120), in which the premixing chamber (114) is supplied with air which is guided by a cavity (116) which is located between the flame tube (112) and outer walls (118) of the combustion chamber (110), this air circulating in the opposite direction to the flow of combustion products; a first cylindrical region (122) of the flame tube (112) is surrounded by a cylindrical casing (136) which creates an annular chamber (138).

12 Claims, 2 Drawing Sheets

140
148
136
138
142
144
146
134
142
140

112
116
128
126
118
122
110
136
118
120
114

FLAME TUBE OR "LINER" FOR A COMBUSTION CHAMBER OF A GAS TURBINE WITH LOW EMISSION OF POLLUTANTS

TECHNICAL FIELD OF THE INVENTION

The present invention relates to an improved flame tube or "liner" for a combustion chamber of a gas turbine with low emission of pollutants.

BACKGROUND OF THE INVENTION

As is known, a gas turbine is a machine consisting of a compressor and a turbine with one or more stages, in which these components are interconnected by a rotating shaft and in which a combustion chamber is provided between the compressor and the turbine.

Air from the external environment is supplied to the compressor where it is pressurized.

The pressurized air passes through a duct, terminating in a converging portion, into which a set of injectors supplies fuel which is mixed with the air to form a fuel-air mix for combustion.

The fuel required for the combustion is therefore introduced into the combustion chamber through one or more injectors, supplied from a pressurized network, the combustion process being designed to cause an increase in the temperature and enthalpy of the gas.

A parallel fuel supply system, for generating a pilot flame in the proximity of the mixing duct, is also generally provided in order to improve the stability characteristics of the flame.

Finally, the gas at high temperature and high pressure passes through suitable ducts to reach the various stages of the turbine, which converts the enthalpy of the gas into mechanical energy which is available to a user.

It is well known that the primary considerations in the design of combustion chambers for gas turbines are the flame stability and the control of excess air, the aim being to establish ideal conditions for the combustion.

A second element influencing the design of combustion chambers of gas turbines is the tendency to make the combustion take place as near as possible to the dome of the combustion chamber.

More specifically, the prior art provides for the use of a flame tube or "liner" within the combustion chamber; this has two principal functions.

In the first place, the flame is contained within the tube, thus preventing contact with the outer walls of the combustion chamber, in order to avoid overheating.

Secondly, the tube decelerates and diffuses the flow of the combustion products, preventing the extinguishing of the flame.

Additionally, combustion chambers very commonly have premixing chambers upstream from them, in which air which has previously been used to cool the walls of the combustion chamber is mixed with the fuel.

It is convenient to form a cavity around the flame tube.

This cavity carries pressurized air which circulates in the opposite direction to the flow of combustion products leaving the combustion chamber.

As stated above, this air is used as the combustion air to be mixed with the fuel in the premixing chamber and as the cooling air for cooling both the combustion chamber and the combustion products.

In order to achieve low polluting emissions of nitrogen oxides at all levels of loading of the turbine, the combustion air passes from the cavity, outside the tube flame, to the premixing chamber through apertures in the outer surface of the latter, and can be constricted.

The constriction is applied as a function of the quantity of fuel used, in such a way that the ratio between combustion air and fuel is kept constant at the optimal value.

In the prior art, the flame tube is positioned at the outlet of a truncated conical end connected to the premixing chamber, in the actual combustion region, or the main flame region, of the chamber.

Cooling air, pressurized for example by an axial compressor and circulating in the opposite direction to the flow of combustion products leaving the combustion chamber, flows between the flame tube and the outer walls of the combustion chamber.

The flame tube is connected by means of a truncated conical end to the premixing chamber, and has a cylindrical structure, which essentially contains two distinct regions.

A first region, located around the main flame, comprises a cylindrical casing with no apertures, while the second, longer, region has a set of apertures or holes and channels for guiding the air passing through them in a direction parallel to the wall of the said region.

Additionally, a cavity, whose outer surface has numerous small holes for the admission of air, is created around the truncated conical end.

Thus the pressurized air which passes through these holes creates a large number of air draughts directed towards the outer surface of the first region, thus providing cooling essentially by convection.

In the first region, there are no apertures; this prevents the incoming air from causing incomplete combustion which would give rise to problems of polluting emissions.

In the second region, however, the effect of the cooling air on the completeness of the combustion is less significant, and therefore the wall has numerous apertures, producing a flow of air which passes over the interior of the wall and thus cools it.

BRIEF SUMMARY OF THE INVENTION

The object of the present invention is therefore to improve the aforementioned flame tube in such a way that its capacity for cooling in the first region is increased.

It is particularly desirable to improve this characteristic, with the primary aim of reducing polluting emissions to a minimum, while meeting the other requirements of satisfactory combustion such as those mentioned immediately below.

Another object of the present invention must therefore be that of providing an improved flame tube or "liner" for a combustion chamber of a gas turbine with low emission of pollutants which also provides good flame stability.

A further object of the present invention is to provide an improved flame tube or "liner" for a combustion chamber of a gas turbine with low emission of pollutants which reduces the pressure oscillations in the combustion chamber, thus acting as an acoustic damper.

Yet another object of the present invention is to provide an improved flame tube or "liner" for a combustion chamber of a gas turbine with low emission of pollutants which ensures high combustion efficiency.

An additional object of the present invention is to provide an improved flame tube or "liner" for a combustion chamber of a gas turbine with low emission of pollutants which enables the average life of components subject to high temperatures to be increased.

Another additional object of the present invention is to provide an improved flame tube or "liner" for a combustion chamber of a gas turbine with low emission of pollutants which is particularly reliable, simple, and functional, and has relatively low production and maintenance costs.

These and other objects of the present invention are achieved by making an improved flame tube or "liner" for a combustion chamber of a gas turbine with low emission of pollutants as described in claim 1.

Advantageously, the improved flame tube or "liner" for a combustion chamber of a gas turbine with low emission of pollutants according to the present invention can be made to be substituted easily in combustion chambers which are known in the prior art and are therefore already installed.

The characteristics and advantages of an improved flame tube or "liner" for a combustion chamber of a gas turbine with low emission of pollutants according to the present invention will be made clearer by the following description, provided by way of example, and without restrictive intent, with reference to the attached schematic drawings, in which:

BRIEF DESCRIPTION OF THE DRAWING FIGURES

DETAILED DESCRIPTION OF THE INVENTION

Figure 1:
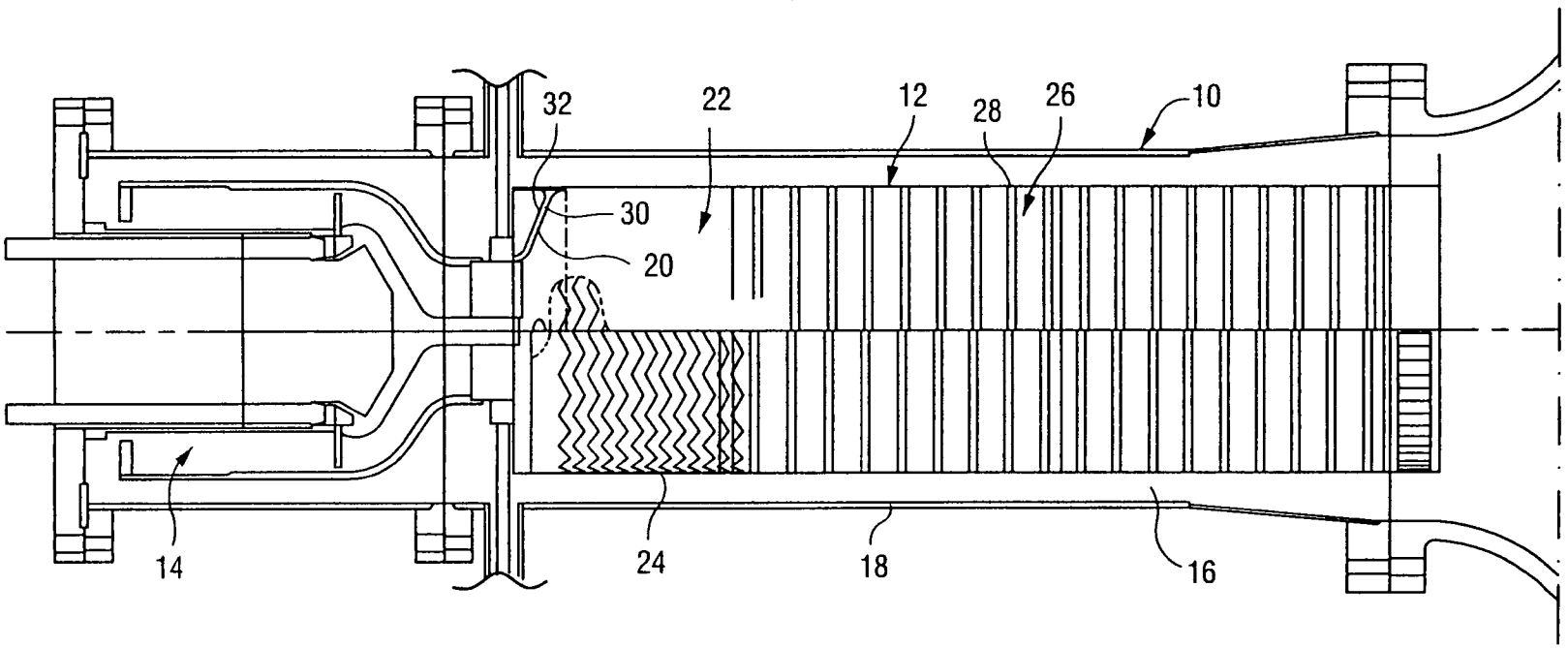
Fig.1 PRIOR ART
FIG. 1 is a longitudinal view, in partial section, of a flame tube or "liner" in a combustion chamber for gas turbines, according to the prior art.

With reference to FIG. 1, a combustion chamber, indicated as a whole by the number 10, of a gas turbine is shown, a flame tube or "liner" 12 according to the prior art being located inside the chamber.

Upstream from the flame tube 12 there is a premixing chamber 14, supplied with combustion air which is guided by a cavity 16 located between the flame tube 12 and the outer walls 18 of the combustion chamber 10.

The flame tube 12 is located at the outlet of a truncated conical end 20 connected to the premixing chamber 14, in the actual combustion region, or main flame region, of the said combustion chamber 10.

Cooling air, pressurized by an axial compressor which is not shown in the figure, flows between the flame tube 12 and the outer walls 18 of the combustion chamber 10, in the opposite direction to the flow of combustion products leaving the combustion chamber 10.

The flame tube 12 has a cylindrical structure, which essentially contains two distinct regions.

A first cylindrical region 22, located around the main flame, comprises a cylindrical casing 24 with no apertures, while a second, longer, cylindrical region 26 has a set of apertures or holes 28.

Additionally, a cavity 30, whose outer surface 32 has numerous small holes for the admission of air, is created around the truncated conical end 20.

Thus the pressurized air which passes through these holes creates a large number of air draughts directed towards the truncated conical end 20, thus providing cooling essentially by convection.

In the second region 26, on the other hand, the cooling takes place essentially by means of a layer of air which is adjacent to the inside of the wall and is generated by the passage of air through the apertures 28.

Figures 2, 3:
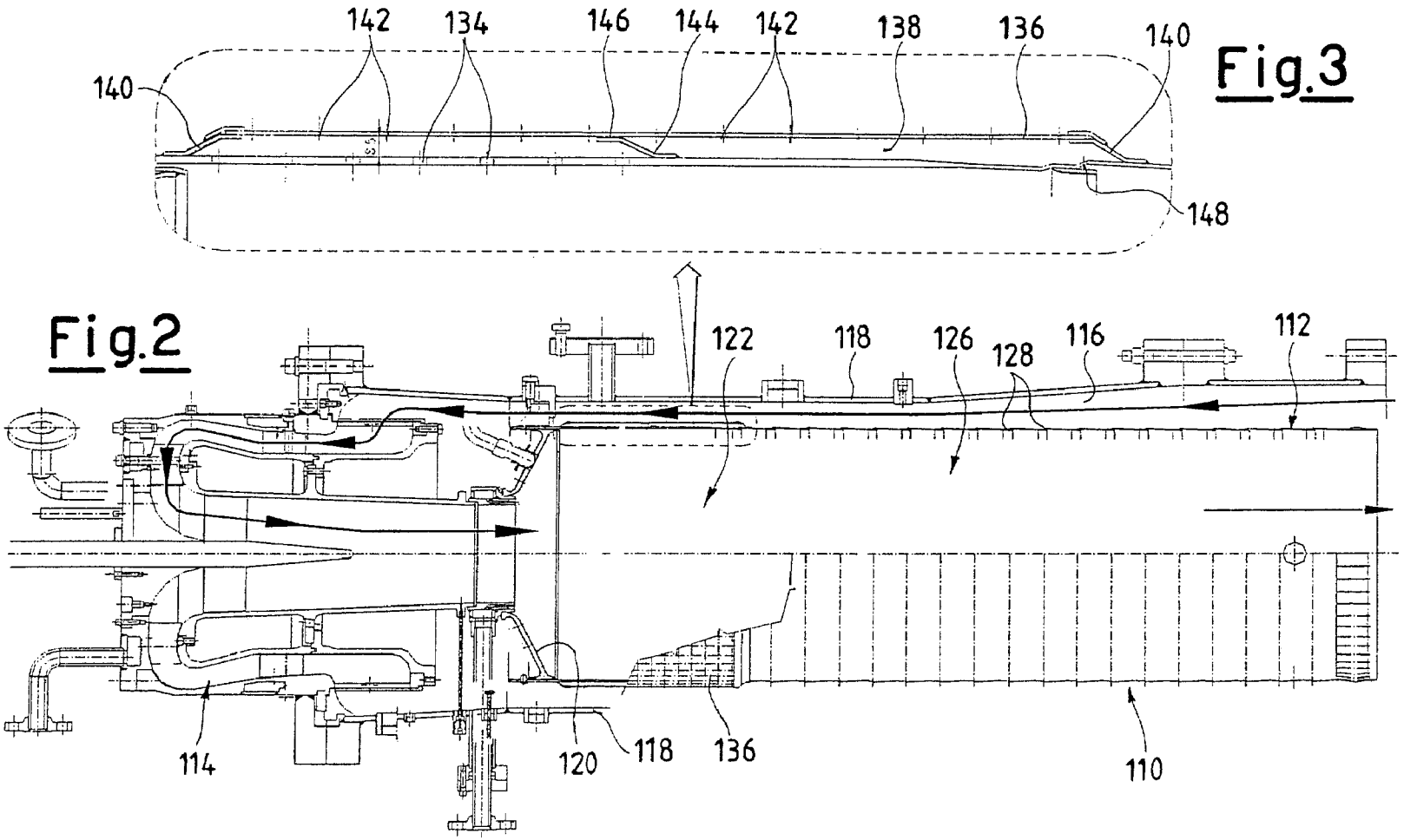
FIG. 2 is a longitudinal view, in partial section, of a flame tube or "liner" in a combustion chamber for gas turbines, according to the present invention.
FIG. 3 is an enlarged view in longitudinal section of a detail of FIG. 2.

FIGS. 2 and 3 show a combustion chamber, indicated as a whole by the number 110, of a gas turbine, in which is positioned a flame tube or "liner" 112 according to the present invention, where components identical and/or equivalent to those shown in FIG. 1 in relation to the prior art have the same reference numbers, increased by 100 in each case.

In the illustrated example, a premixing chamber 114 is provided upstream from the flame tube 112, and is supplied with combustion air which is guided by a cavity 116 located between the flame tube 112 and the outer walls 118 of the combustion chamber 110.

The flame tube 112 is positioned at the outlet of a truncated conical end 120 connected to the premixing chamber 114, in an actual combustion region, or main flame region, of the said combustion chamber 110.

Cooling air, pressurized by an axial compressor which is not shown in the figure, and circulating in the opposite direction to the flow of combustion products leaving the combustion chamber 110, flows between the flame tube 112 and the outer walls 118 of the combustion chamber 110.

The flame tube 112 has a cylindrical structure, which essentially contains two distinct regions.

A first cylindrical region 122 is located around the main flame, comprises a cylindrical casing with no apertures, while the second cylindrical region 126, which is longer and is similar to that of the prior art, guides the combustion products and has a set of apertures or holes 128.

The first cylindrical region 122 has a set of apertures or holes 134, positioned for example at the nodes of a square mesh, and formed in an area close to the truncated conical end 120.

This region 122 is enclosed by a cylindrical casing 136, which surrounds it, leaving a space for an annular chamber 138.

The casing 136 has annular joints 140 at both of its ends, which connect it to the first cylindrical region 122 and enclose the annular chamber 138.

These annular joints 140 are made, for example, by welding shaped sections which are inclined with respect to the axis of the flame tube 112 to the first cylindrical region 122.

A set of apertures or holes 142, positioned for example at the nodes of square meshes identical to those of the holes 134 of the cylindrical region 122, is formed in the casing 136.

Conveniently, these holes 142 in the casing 136 are smaller than the holes 134 in the cylindrical region 122, and are staggered with respect to the latter.

The first cylindrical region 122 also has a part without apertures, and this part is located in a region opposite the truncated conical end 120.

A separator element 144, of annular form, is provided in the annular chamber 138, between the part of the region 122 having holes 134 and the part without apertures.

The separator element 144 has at least one gap 146 for connecting two portions of the chamber 138 defined by the said separator element 144.

This separator element 144 is conveniently formed by welding on to the first cylindrical region 122 a shaped section inclined towards the truncated conical end 120 of the combustion chamber 110.

Finally, a circumferential set of small holes 148, whose sizes are, for example, greater than those of the holes 142 in the casing 136, is formed in the part of the cylindrical region 122 without apertures in the proximity of the annular joint 140.

The operation of the improved flame tube or "liner" 112 for a combustion chamber 110 of a gas turbine with low emission of pollutants according to the invention is made clear by the description provided above with reference to the figures, and is briefly as follows.

Cooling air is pressurized by an axial compressor, which is not shown in the figures, and cools the flame tube 112.

As it cools the flame tube 112, the air is heated and then enters the premixing chamber 114, thus acting as combustion air.

In the second cylindrical region 126, the cooling is essentially provided by a layer of air which is adjacent to the inside of the wall, and which is generated by the passage of the air through the apertures 128, as in the prior art.

In the first cylindrical region 122, however, the cooling is essentially provided by what is known as "impingement cooling", and not solely by convection as it is in the prior art.

Impingement cooling is a heat transfer mechanism which is created by the impact of fluids on a surface.

In this case, the pressurized air which passes through the holes 142 in the casing 136 creates a corresponding number of air draughts directed towards the first cylindrical region 122.

A very thin hydrodynamic and thermal boundary layer is created around the impact regions, as a result of the deceleration of the draught and the increase in pressure.

Consequently, extremely high heat exchange coefficients are obtained in these regions, and heat is therefore transferred very easily at these points.

The part of the annular chamber 138 where the apertures 134 are provided acts as an acoustic damper to counteract the pressure oscillations occurring within the flame tube 112.

The set of holes 148 is provided in a region in which the admission of air into the flame tube 112 does not create problems of incomplete combustion and consequent emission of pollutants.

Similarly, the apertures 134 must allow only a minimal admission of air, in order to prevent the said pollution problems.

The above description clearly indicates the characteristics of the improved flame tube or "liner" for a combustion chamber of a gas turbine with low emission of pollutants, which is the object of the present invention, and also makes clear the corresponding advantages, which include:

- an improved cooling capacity;
- reduced pressure oscillations in the combustion chamber and good flame stability;
- high combustion efficiency;
- an increased average life of the components which are subjected to high temperatures;
- simple and reliable use;
- low costs of production and maintenance by comparison with the prior art;
- excellent interchangeability with the flame tubes of the combustion chambers known in the art, resulting in easy fitting in previously installed gas turbines which are to be upgraded.

Finally, it is evident that the improved flame tube or "liner" for a combustion chamber of a gas turbine with low emission of pollutants designed in this way can be modified and varied in numerous ways, all included within the scope of the invention.

Moreover, all the components can be replaced with technically equivalent elements.

In practice, the materials used, as well as the shapes and dimensions, can be varied at will according to technical requirements that may arise from time to time.

The scope of protection of the invention is therefore delimited by the attached claims.

What is claimed is:

1. A combustor for a gas turbine, comprising;

an outer wall, a liner within the outer wall, said outer wall and said liner defining a cavity therebetween;

a premixing chamber;

a combustion chamber within said liner;

said liner including a cylindrical structure connected to an outlet of said premixing chamber by a truncated conical end, said premixing chamber being supplied with air flowing along said cavity in an opposite direction to a flow of combustion products through the combustor;

said cylindrical structure including a first cylindrical region of said liner surrounded by a cylindrical casing within said outer wall and forming an annular chamber with said liner, said cylindrical structure including a first set of apertures in said first cylindrical region for admitting air from said annular chamber through the liner into the combustion chamber enabling a damping of pressure oscillations within the liner.

2. A combustor according to claim 1 wherein said first set of apertures of the said first cylindrical region are positioned at the nodes of square meshes and formed in a first portion of said first cylindrical region axially close to said truncated conical end.

3. A combustor according to claim 1 wherein said cylindrical casing has annular joints at axially opposite ends which connect said cylindrical casing to the first cylindrical region and enclose said annular chamber.

4. A combustor according to claim 1 including a second set of apertures formed in said cylindrical casing for impingement cooling of said first cylindrical region.

5. A combustor according to claim 4 wherein said second set of apertures are positioned on the nodes of square meshes.

6. A combustor according to claim 5 wherein said first set of apertures of the said first cylindrical region are positioned at the nodes of square meshes and formed in a first portion of said first cylindrical region axially close to said truncated conical end;

said meshes of said second set of apertures in said cylindrical casing being identical to said meshes of said first set of apertures in said first cylindrical region.

7. A combustor according to claim 4 wherein said second set of apertures in said cylindrical casing are smaller than the said first set of apertures in the said first cylindrical region and are staggered relative to one another.

8. A combustor according to claim 1 wherein said first cylindrical region has a first cylindrical portion without apertures located in a part axially opposite said truncated conical end.

9. A combustor according to claim 8 wherein said first cylindrical region has a second cylindrical portion with said first set of apertures, annular separator element in said annular chamber between said first cylindrical portion of said first cylindrical region without said apertures and said second cylindrical portion with said first set of apertures.

10. A combustor according to claim 1 including a second cylindrical region longer than said first cylindrical region, said second cylindrical region having a further set of apertures.

11. A combustor for a gas turbine, comprising:

an outer wall, a liner within the outer wall, said outer wall and said liner defining a cavity therebetween;

a premixing chamber;

a combustion chamber within said liner;

said liner including a cylindrical structure connected to an outlet of said premixing chamber by a truncated conical end, said premixing chamber being supplied with air flowing along said cavity in an opposite direction to a flow of combustion products through the combustor;

said cylindrical structure including a first cylindrical region of said liner surrounded by a cylindrical casing within said outer wall and forming an annular chamber with said liner;

said first cylindrical region having a first cylindrical portion without apertures located axially opposite said truncated conical end and a second cylindrical portion having a first set of apertures, an annular separator element in said annular chamber between said first cylindrical portion without apertures and said second cylindrical portion having said first set of apertures, said annular separator element having at least one orifice for connecting the first cylindrical portion and the second cylindrical portion of the annular chamber defined in part by said separator element.

12. A combustor according to claim 11 including a circumferential set of holes formed in said first cylindrical portion of the cylindrical region without apertures adjacent an annular joint between said liner and said cylindrical casing.

* * * * *

UNITED STATES PATENT AND TRADEMARK OFFICE

CERTIFICATE OF CORRECTION

PATENT NO. : 6,966,187 B2
DATED : November 22, 2005
INVENTOR(S) : Modi, R. et al.

It is certified that error appears in the above-identified patent and that said Letters Patent is hereby corrected as shown below:

Column 6,
Line 66, insert -- an -- between “apertures,” and “annular”.

Signed and Sealed this

Seventh Day of March, 2006

JON W. DUDAS
*Director of the United States Patent and Trademark Office*